US010612103B2

(12) United States Patent
Kim

(10) Patent No.: US 10,612,103 B2
(45) Date of Patent: Apr. 7, 2020

(54) MANUFACTURING METHOD OF RECYCLING LEATHER SHEET USING FIBER OF LEATHER

(71) Applicant: ATKO PLANNING INC., Paju-si, Gyeonggi-do (KR)

(72) Inventor: Jieon Kim, Seoul (KR)

(73) Assignee: ATKO PLANNING INC., Paju-si, Gyeonggi-do (KR)

( * ) Notice: Subject to any disclaimer, the term of this patent is extended or adjusted under 35 U.S.C. 154(b) by 234 days.

(21) Appl. No.: 15/516,899

(22) PCT Filed: Dec. 6, 2016

(86) PCT No.: PCT/KR2016/014250
§ 371 (c)(1),
(2) Date: Apr. 5, 2017

(87) PCT Pub. No.: WO2017/195962
PCT Pub. Date: Nov. 16, 2017

(65) Prior Publication Data

US 2018/0094329 A1 Apr. 5, 2018

(30) Foreign Application Priority Data

May 9, 2016 (KR) ..... 10-2016-0056347

(51) Int. Cl.

| | |
|---|---|
| ***C14B 1/06*** | (2006.01) |
| ***C14C 3/02*** | (2006.01) |
| ***D02G 3/04*** | (2006.01) |
| ***C14B 1/30*** | (2006.01) |
| ***C14B 1/56*** | (2006.01) |
| ***C14B 3/00*** | (2006.01) |
| ***C14B 7/02*** | (2006.01) |

(52) U.S. Cl.
CPC ..... *C14B 1/06* (2013.01); *C14B 1/30* (2013.01); *C14B 1/56* (2013.01); *C14B 3/00* (2013.01); *C14B 7/02* (2013.01); *C14C 3/02* (2013.01); *D02G 3/042* (2013.01)

(58) Field of Classification Search
CPC .... C14B 1/06; C14B 1/02; C14B 1/30; C14B 1/56
See application file for complete search history.

(56) References Cited

U.S. PATENT DOCUMENTS 4,253,318 A * 3/1981 Repetto ..... C14B 1/06 69/13
2018/0094329 A1* 4/2018 Kim ..... C14B 1/06

FOREIGN PATENT DOCUMENTS

KR 10-2008-0058495 A 6/2008
KR 10-1022828 B1 3/2011

* cited by examiner

*Primary Examiner* — Clinton T Ostrup
*Assistant Examiner* — Andrew Wayne Sutton
(74) *Attorney, Agent, or Firm* — Revolution IP, PLLC

(57) ABSTRACT

A method of preparing recycling leather sheets comprise: pre-processing where leather wastes are neutralized and fatliquoring agents are adhered; separating leather fibers from the leather wastes that has undergone the pre-processing; mixing the separated leather fibers with fibers for improving a tensile strength of the separated leather fibers; and forming sheets by combining the mixed leather fibers and raw fabrics for floor. The method of preparing recycling leather sheets in the present invention may reduce environmental pollution by preparing recycling leather sheets through physical combination without using adhesives.

10 Claims, 6 Drawing Sheets

【FIG. 1】
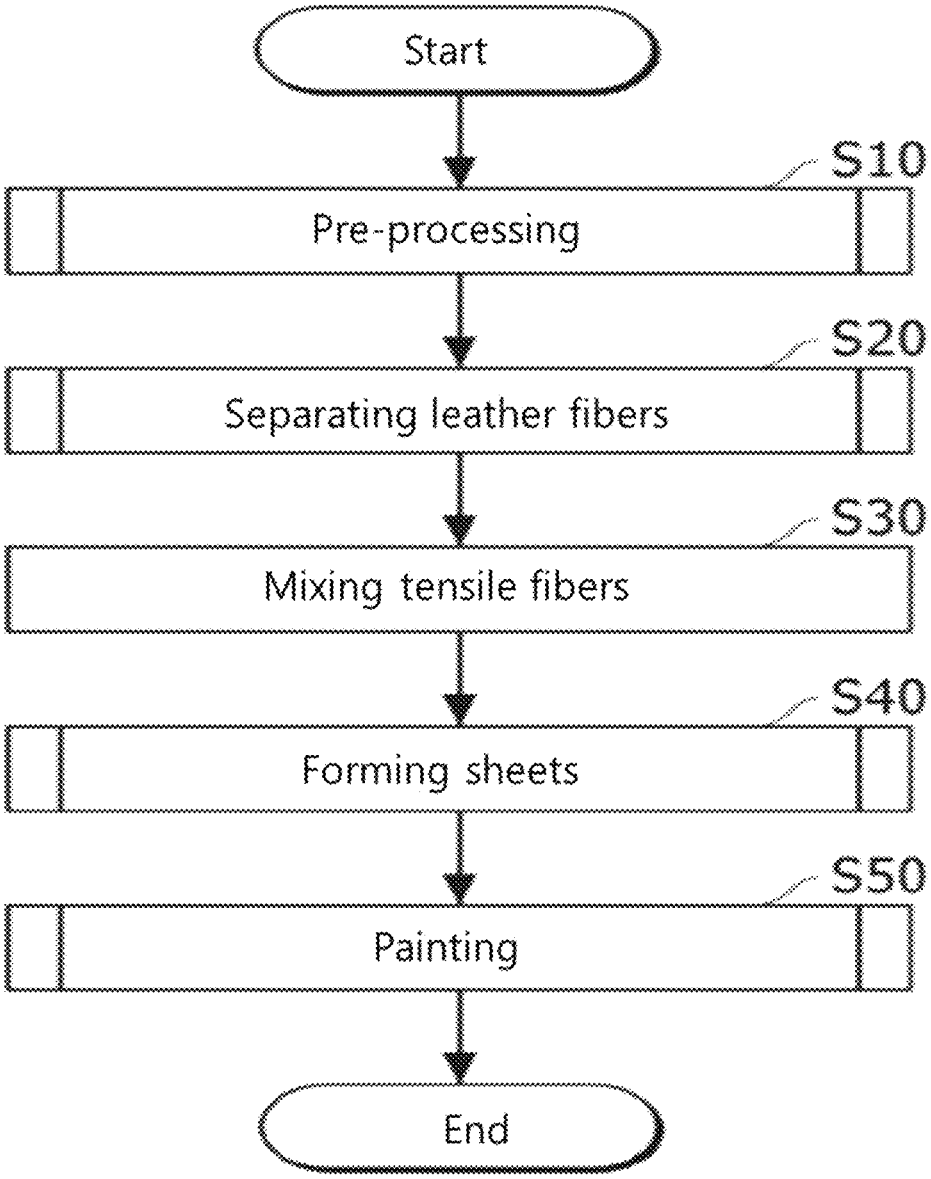

【FIG. 2】
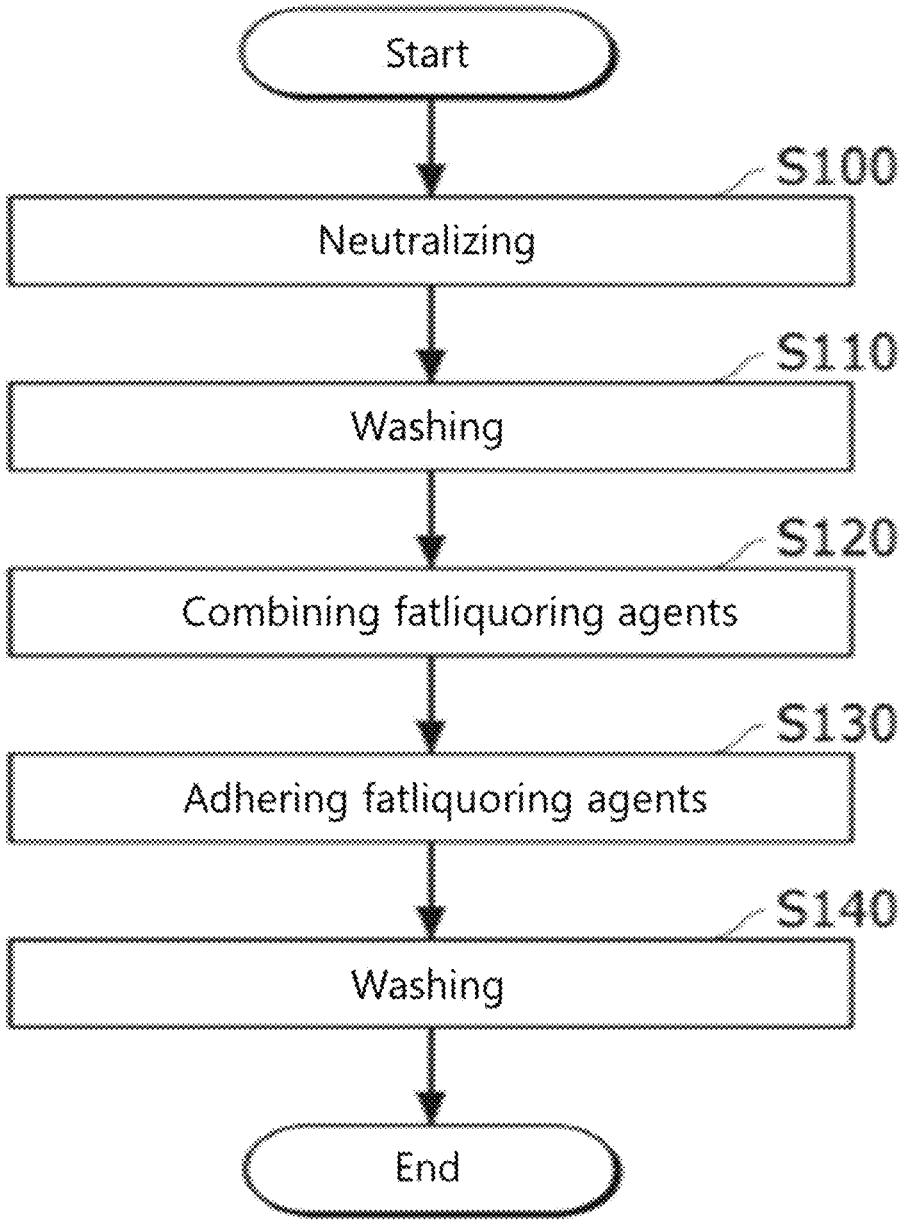

【FIG. 3】
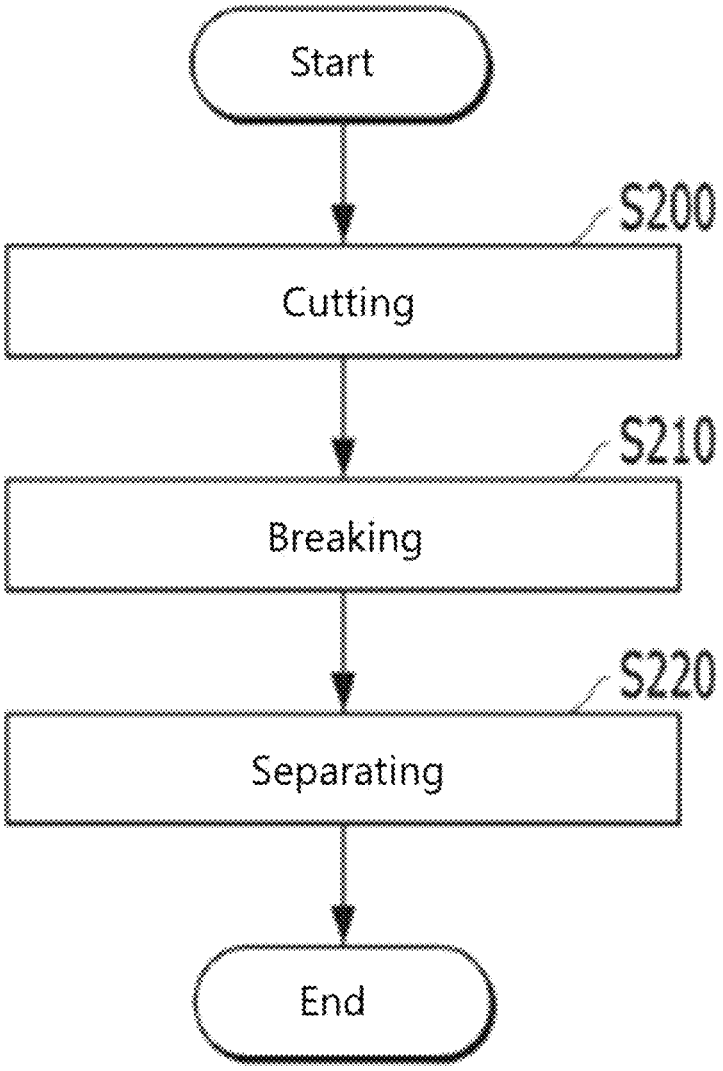

【FIG. 4】
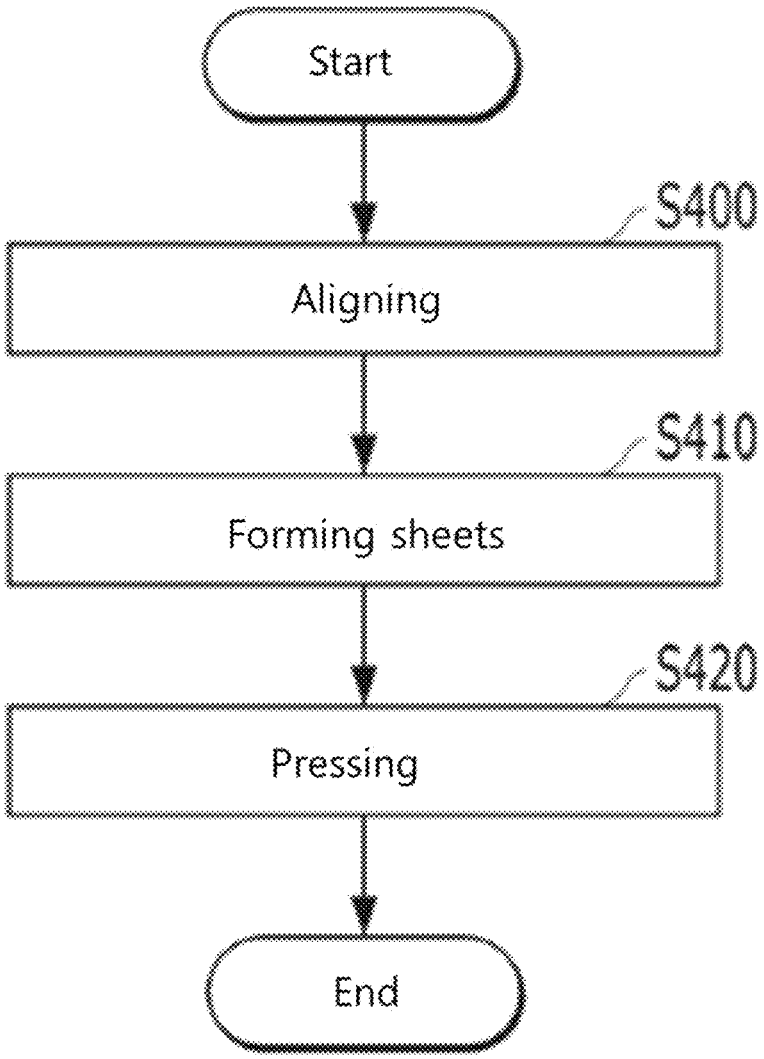

【FIG. 5】
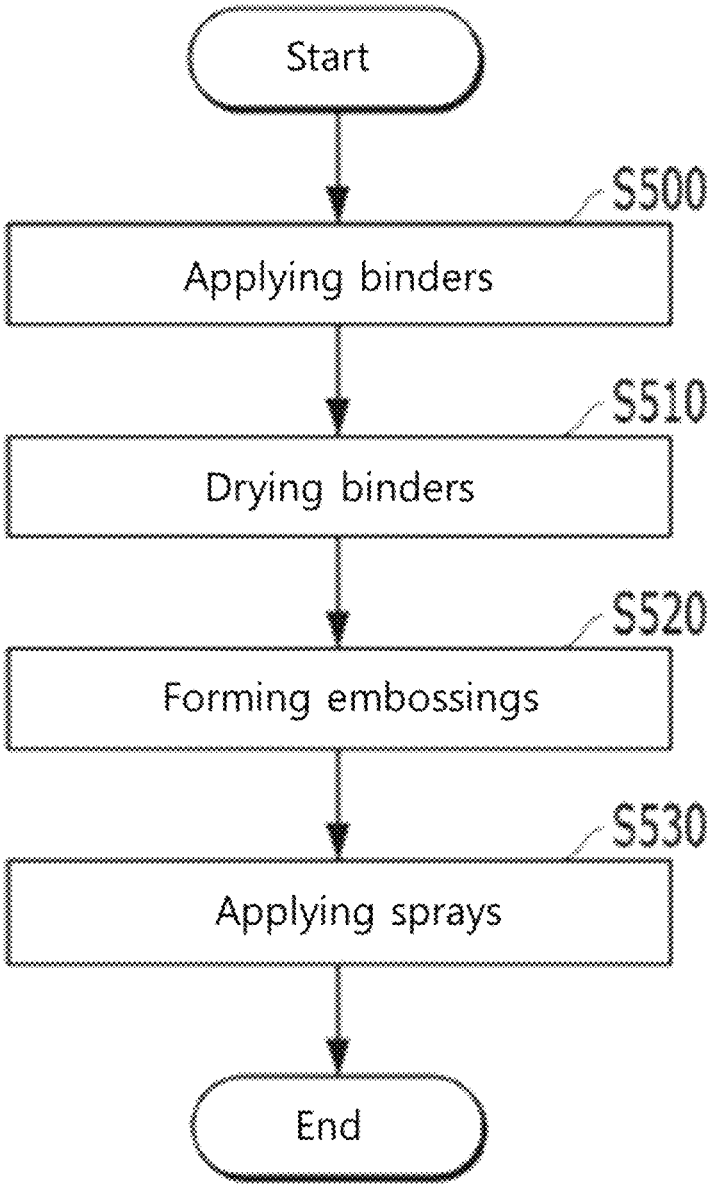

[FIG. 6]
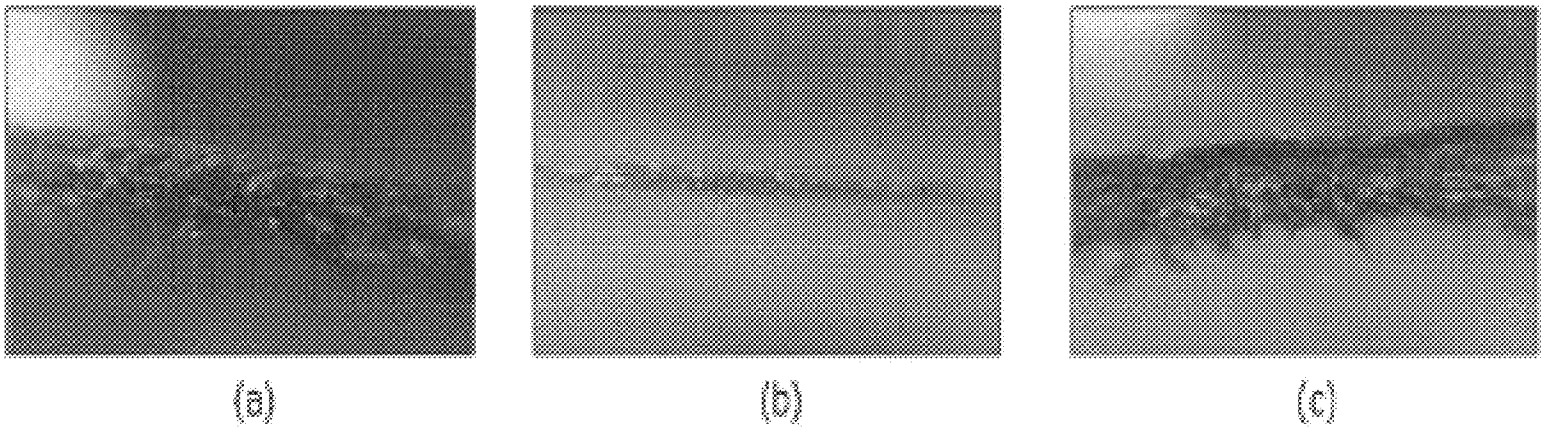
[FIG. 7]
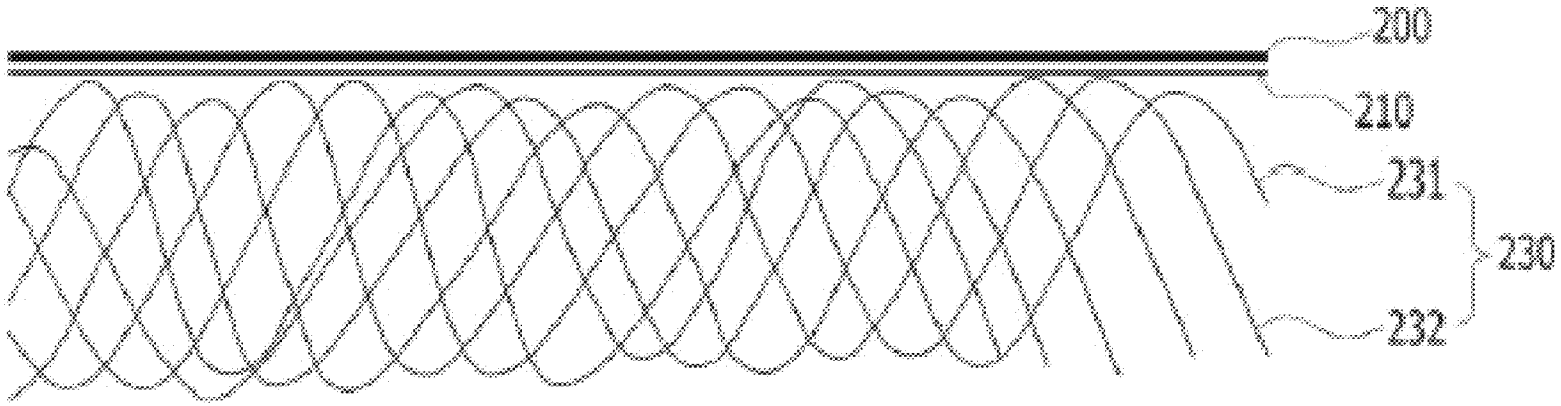

MANUFACTURING METHOD OF RECYCLING LEATHER SHEET USING FIBER OF LEATHER

CROSS REFERENCE TO PRIOR APPLICATIONS

This application is a National Stage Application of PCT International Patent Application No. PCT/KR2016/014250 filed on Dec. 6, 2016, under 35 U.S.C. § 371, which claims priority to Korean Patent Application No. 10-2016-0056347 filed on May 9, 2016, which are all hereby incorporated by reference in their entirety.

TECHNICAL FIELD

The present invention relates to a method of preparing recycling leather sheets, and more particularly, to a method of preparing recycling leather sheets using leather fibers separated from leather wastes.

BACKGROUND ART

Natural leather is a durable skin wrapping animals' body. Due to its outstanding physical properties, it is widely used in various fields, such as bags, shoes and furniture. The natural leather is separated from the animals' body and processed through chemical and physical procedures for an end product. During various processing, it is essential to cut in accordance with the design of the desired product. Because of the cutting process, a large amount of leather wastes occurs. Since most of these wastes are disposed at facilities for combustion or landfill, environmental problems arise seriously.

Thus, various studies are being carried out to recycle burned or landfilled leather wastes. As part of such efforts, technology has been developed for grinding leather wastes and preparing artificial leather using synthetic resin adhesive. A related patent is Republic of Korea Patent No. 10-1022828 (A dry synthetic leather, a manufacturing method and a manufacturing system therefor, Mar. 3, 2011.).

However, the above technology grinds leather wastes and uses synthetic resin adhesive to prepare recycling leather sheets. Accordingly, there is a limitation that environmental pollution still exists due to toxic gas generated during hardening, heating and rolling the synthetic resin adhesive.

Therefore, new needs for a method of preparing recycling leather sheets that may reduce environmental pollution have arisen.

DETAILED DESCRIPTION OF THE INVENTION

Technical Problem to be Solved

The present invention which reflects the needs of users as described above provides a method of preparing recycling leather sheets to minimize environmental pollution.

Means of Solving Problem

According to an exemplary embodiment of the present invention, a method of preparing recycling leather sheets using leather fibers includes: pre-processing where leather wastes are neutralized and fatliquoring agents are adhered; separating leather fibers from the leather wastes of the pre-processing; mixing the separated leather fibers with fibers for improving a tensile strength of the separated leather fibers; and forming sheets by combining the mixed leather fibers in the mixing to raw fabrics for floor.

The pre-processing may include: neutralizing the leather wastes; washing the leather wastes that has undergone the neutralizing; combining the fatliquoring agents to the leather wastes after the washing; adhering the fatliquoring agents to the leather wastes after the combination; and washing the leather wastes after the adherence.

The neutralization may be performed by mixing 90 to 100 parts by weight of water, 1 to 5 parts by weight of sodium formate, and 1 to 5 parts by weight of sodium bicarbonate based on the 100 parts by weight of the leather wastes.

The combination may be performed by mixing 90 to 100 parts by weight of water, 0.5 to 1.5 parts by weight of aqueous ammonia, and 15 to 19 parts by weight of fatliquoring agents based on the 100 parts by weight of the leather wastes.

The adherence may be performed by adding 0.5 to 2.0 parts by weight of formic acid based on the 100 parts by weight of the leather wastes.

The separation may include: cutting the leather wastes that has undergone the pre-processing to 5 to 15 cm by using leather grinding machines; breaking bonds between leather fibers of the leather wastes by using hammer mills or roll mills; and separating leather fibers from the leather wastes where the bonds between leather fibers has been broken by using leather cotton gins.

The mixing may be performed by mixing 10 to 20 parts by weight of the fibers to improve a tensile strength based on the 100 parts by weight of the separated leather fibers.

The fibers to improve a tensile strength may be at least one of crimped yarn, wool, polypropylene, low melt fiber, and hot melt fiber.

The formation may include: aligning the mixed leather fibers by using carding machines; stacking the raw fabrics for floor and the aligned fibers by crossing each other; and forming sheets by combining the raw fabrics for floor to the aligned fibers where needle punches hit in 800 to 1,000 times.

The present invention may further include pressing the sheets by using roll mills.

The present invention further includes painting surfaces, and the painting surfaces may include: applying binders to sheet surfaces by using roll coaters; drying the binders applied to the sheet surfaces by using dry chambers; forming embossings on the sheet surfaces where the binders are located; and applying top clear coating sprays and antifouling sprays to the sheet surfaces where embossings are formed.

A recycling leather sheet according to an exemplary embodiment of the present invention includes: fiber layers including leather fibers and fibers mixed with the leather fibers for improving a tensile strength of the leather fibers; and layers of raw fabric for floor located on upper surfaces of the fiber layers with physically or chemically being combined with the fiber layers.

Effects of the Invention

As described above, a method of preparing recycling leather sheets in the present invention may minimize environmental pollution because the method may prepare recycling leather sheets by physical combination without using adhesives.

BRIEF DESCRIPTION OF THE DRAWINGS

FIG. 1 is a view showing a method of preparing recycling leather sheets using leather fibers according to an exemplary embodiment of the present invention.

FIG. 2 is a flowchart showing detailed steps of the pre-processing (S10) of FIG. 1.

FIG. 3 is a flowchart showing detailed steps of the separation (S20) of FIG. 1.

FIG. 4 is a flowchart showing detailed steps of the formation (S40) of FIG. 1.

FIG. 5 is a flowchart showing detailed steps of the painting (S50) of FIG. 1.

FIG. 6a-c is a view comparing a recycling leather sheet, according to an exemplary embodiment of the present invention, with a wet recycling leather sheet and a natural leather.

FIG. 7 is an enlarged view of a cross section of a recycling leather sheet according to an exemplary embodiment of the present invention.

BEST MODE FOR CARRYING OUT THE INVENTION

A method of preparing recycling leather sheets using leather fibers according to an exemplary embodiment of the present invention includes: pre-processing where leather wastes are neutralized and fatliquoring agents are adhered; separating leather fibers from the leather wastes that has undergone the pre-processing; mixing the separated leather fibers and fibers for improving a tensile strength of the separated leather fibers; and forming sheets by combining the mixed leather fibers and raw fabrics for floor.

The pre-processing may include: neutralizing the leather wastes; washing the leather wastes that has undergone the neutralizing; combining the fatliquoring agents to the leather wastes after the washing; adhering the fatliquoring agents to the leather wastes after the combination; and washing the leather wastes after the adherence.

[Modes for Carrying Out the Invention]

The present invention will be described more fully hereinafter with reference to the accompanying drawings, in which exemplary embodiments of the invention are shown to be easily implemented by those of ordinary skill in the art. The present invention may, however, be modified in various ways and should not be construed as limited to the embodiments set forth herein. The parts not related to the description will be omitted to clearly describe the present invention. In addition, similar parts throughout the specification are designated by like reference numerals.

FIG. 1 is a view showing a method of preparing recycling leather sheets using leather fibers according to an exemplary embodiment of the present invention. The recycling leather sheet in the present invention is prepared through pre-processing where leather wastes are neutralized and fatliquoring agents are adhered (S10), separating leather fibers from leather wastes (S20), mixing the separated leather fibers and fibers for improving a tensile strength of the separated leather fibers (hereinafter "tensile fiber") (S30), and forming sheets by combining the mixed fibers in the mixing to raw fabrics for floor (S40). Additionally, painting surfaces (S50) may be included according to an exemplary embodiment of the present invention.

The pre-processing (S10) weakens the chromium bonds formed between leather fibers of the leather wastes and softens the leather fibers. This will be described in detail in FIG. 2.

FIG. 2 is a flowchart showing detailed steps of the pre-processing (S10) of FIG. 1. The pre-processing where neutralizing leather wastes and adhering fatliquoring agents (S10) includes: neutralizing the leather wastes (S100); washing the neutralized leather wastes (S110); combining the fatliquoring agents to the leather wastes (S120); adhering the fatliquoring agents to the leather wastes (S130); and washing the leather wastes where the fatliquoring agents are adhered (S140).

The neutralization (S100), as a step of neutralizing acidic leather wastes, is preferably performed by mixing 90 to 100 parts by weight of water at 30 to 50 degrees and 1 to 5 parts by weight of sodium formate for 20 to 40 minutes based on the 100 parts by weight of the leather wastes, and then by mixing 1 to 5 parts by weight of sodium bicarbonate for 90 to 120 minutes based on the 100 parts by weight of the leather wastes. The leather wastes neutralized in the proportion may be advantageous to the separation of the leather fibers because the chromium bonds formed between the leather fibers are weakened.

The washing (S110) rinses the neutralized leather wastes with water, and it is continued until impurities are removed.

The combination (S120) where leather wastes is softened is performed by mixing 90 to 100 parts by weight of water at 40 to 60 degrees and 0.5 to 1.5 parts by weight of aqueous ammonia and 15 to 19 parts by weight of fatliquoring agents for 40 to 60 minutes based on 100 parts by weight of leather wastes. At this time, the fatliquoring agent is a vegetable fat that promotes flexibility in leather. The leather wastes to which the fatliquoring agents are added as the above ratio may prevent the adherence of leather fibers and increase the flexibility and elasticity.

The adherence (S130) stabilizes bonds between fatliquoring agents and leather wastes, and induces additional bonds with fatliquoring agents by acidifying the leather wastes that has undergone the combination. The adherence, as a step for inducing to combine with fatliquoring agents additionally, is performed by mixing 0.5 to 3.0 parts by weight of formic acid for 10 to 30 minutes based on 100 parts by weight of leather wastes to fully adhere the fatliquoring agents to the leather fibers.

The washing (S140) rinses the leather wastes adhered to the fatliquoring agents with water for 15 to 45 minutes.

When the pre-processing where leather wastes is neutralized and fatliquoring agents are adhered(S10) is completed, proceed to separate leather fibers from leather wastes (S20). In the separation, only leather fibers are separated from the leather wastes that has undergone the pre-processing. This is described in detail in FIG. 3.

FIG. 3 is a flowchart showing detailed steps of the separation (S20) of FIG. 1. Separating leather fibers from leather wastes (S20) includes: cutting leather wastes (S200); breaking bonds between leather fibers of the cut leather wastes (S210); and separating leather fibers from leather wastes where the bonds between leather fibers has been broken (S220).

The cutting (S200) is performed by cutting leather wastes to 5 to 15 cm through leather grinding machines, and the breaking (S210) is performed by breaking bonds between leather fibers through hammer mills or roll mills. In addition, the separation (S220) is performed by separating leather fibers to 2 to 5 cm from leather wastes through leather cotton gins.

When the separation (S20) is finished, proceed to mix leather fibers and tensile fibers (S30). The mixing (S30) is preferably performed by mixing the 10 to 20 parts by weight of the tensile fibers based on the 100 parts by weight of the separated leather fibers. At this time, the tensile fibers include at least one of crimped yarn, wool, polypropylene, low melt fiber and hot melt fiber. In this case, mixing tensile fibers of long fibers may improve the durability of the mixed leather fibers. On the other hand, when tensile fibers of short fibers are mixed, the mixed leather fibers may be softened.

When the mixing(S30) is completed, proceed to form sheets by combining the mixed fibers and raw fabrics for floor (S40). The formation (S40) is performed by aligning the mixed leather fibers in a certain direction, and chemically or physically combining with the raw fabrics for floor for forming plate sheets. This is described in detail in FIG. 4.

FIG. 4 is a flowchart showing detailed steps of the formation (S40) of FIG. 1. The formation where sheets are formed through combining mixed leather fibers and raw fabrics for floor (S40) includes: aligning the mixed leather fibers (S400); and forming sheets by combining the raw fabrics for floor and the aligned fibers (S410). Moreover, the step (S40) may further include pressing the sheets (S420) according to an exemplary embodiment of the present invention.

The alignment (S400) is performed by aligning the mixed in parallel by using carding machines and removing short-length leather fibers and impurities.

The formation (S410), as a step of physically or chemically combining the aligned leather fibers and the raw fabrics for floor, is preferably performed by stacking the raw fabrics for floor and the aligned leather fibers by crossing each other at a height of 20 cm or more, and by hitting them in 800 to 1,000 times by needle punches, and then by combining them. If hit less than 800 times, the aligned leather fibers and the raw fabrics for floor may be separated. Conversely, if hit more than 1,000 times, the raw fabrics for floor may be damaged.

The pressing (S420), as a step of applying pressure to the sheets by using roll mills, may be repeated several times as necessary. The sheets that have undergone the pressing (S420) have higher density and strength of the sheets is improved. The thickness of the sheets that have undergone the pressing twice is 1.0 to 1.8 mm.

When the formation where the sheets are formed through combining mixed leather fibers and raw fabrics for floor (S40) is completed, painting surfaces (S50) according to an exemplary embodiment of the present invention may be added. The painting surfaces (S50) forms coating layers on the sheets surfaces. This is described in detail in FIG. 5.

The FIG. 5 is a flowchart showing detailed steps of the painting (S50) of FIG. 1. The painting surfaces (S50) includes: applying binders to sheet surfaces (S500); drying the binders applied to the sheet surfaces (S510); forming embossings on the sheet surfaces (S520); and applying top clear coating sprays and antifouling sprays to the sheet surfaces (S530).

The applying binders (S500) is a step of applying binders to one side of the sheets where the raw fabrics for floor are placed by passing sheets through roll coders with binders.

The drying binders (S510) is a step of drying the binders applied to the sheets by using dry chambers. In this case, the applying binders (S500) or the drying binders (S510) may be repeated several times as needed.

The forming embossings on the sheet surfaces (S520) is a step of providing three-dimensional effects to the sheets by using an up-down press.

The applying sprays to surfaces (S530) is a step of providing touch feeling by spraying top clear coating sprays and antifouling sprays to the sheet surfaces through auto sprays.

When the painting is performed as described above, films are formed on sheet surfaces, and thus damage caused from the outside may be prevented. The thickness of the sheet that has undergone the painting is 1.0 to 1.4 mm, and its leather content is 75 to 85%, so it has similar durability with that of natural leather.

The FIG. 6 is a view comparing a recycling leather sheet, according to an exemplary embodiment of the present invention, with a wet recycling leather sheet and a natural leather. The FIG. 6 (*a*) is a cross-sectional photograph of natural leather, and (b) is a cross-sectional photograph of wet recycling leather sheet. The FIG. 6 (*c*) is a cross-sectional photograph of recycling leather sheet prepared by a method of the present invention. As shown in FIG. 6, the recycling leather sheet of the present invention has similar cross section with that of natural leather because the present invention prepares leather sheets by using leather fibers separated from leather wastes. Moreover, the recycling leather sheet of the present invention contains 80% or more of leather, so it has also similar physical properties with that of natural leather.

Wet recycling leathers are prepared by grinding shaving scraps (leather wastes) in a wet state, adding various additives and then forming sheets through adhesives. Its cross section is different from that of natural leather.

The FIG. 7 is an enlarged view of a cross section of a recycling leather sheet according to an exemplary embodiment of the present invention. The recycling leather sheet consists of paint layers (200); layers of raw fabric for floor(210); and fiber layers (230). Fiber layers (230) are chemically or physically combined to the one side of layers of raw fabric for floor (210). Paint layers (200) are formed on the other side of layers of raw fabric for floor (210). In this case, the fiber layers (230) consist of leather fibers (231) and fibers for improving a tensile strength of the leather fibers (232), and both fibers are mixed.

Since materials such as fatliquoring agents and fixing agents are known to those skilled in the art of fibers, weaving, and fiber processing, the detailed description of the specific components and machines required therefor will be omitted.

The method of preparing recycling leather sheets using leather fibers in the present invention can minimize environmental pollution because it prepares recycling leather sheets by physical combination without using adhesives.

In the following paragraphs, the present invention will be described in detail by way of exemplary embodiments. However, these examples are intended to be illustrative only and the present invention is not limited to those.

[Exemplary Embodiment]

1,000 g of leather waste, 950 g of water at 40° C., and 30 g of sodium formate were mixed in a drum for 30 minutes for the first neutralization. Then, 30 g of sodium bicarbonate was added and mixed for 115 minutes to carry out the second neutralization. After that, the neutralized leather waste was mixed with cold water and washed them until impurities were removed. Then, the leather waste that has been washed, 1,000 g of water at 55° C., 10 g of aqueous ammonia, and 170 g of fatliquoring agent were placed in a drum and mixed for 60 minutes to carry out combining the fatliquoring agent. Then, 20 g of formic acid was added and mixed for 20 minutes to adhere the fatliquoring agent. After that, the leather waste adhered to fatliquoring agent was mixed with cold water for 25 minutes to carry out washing. Then, the leather waste that had been washed was cut into a length of 7 cm by a leather grinder, and bonds between leather fibers of the cut leather waste were broken by hammer mills and roll mills. Then, 2.7 cm of leather fiber was separated by a leather cotton gin, and the separated leather fiber was mixed with 150 g of crimped yarn. After that, the mixed leather fiber was aligned by a carding machine. Then, the aligned leather fiber and the raw fabric for floor were stacked at a height of 25 cm by crossing each other. Thereafter, sheet was prepared by physically combining the raw fabric for floor to the fiber-mixed leather fiber after a needle punch hit them in 900 times.

INDUSTRIAL APPLICABILITY

A method of preparing recycling leather sheets using leather fibers in the present invention may reduce environmental pollution.

What is claimed is:

1. A method of preparing recycling leather sheets using leather fibers comprising:

pre-processing where leather wastes are neutralized and fatliquoring agents are adhered wherein the pre-processing includes: neutralizing the leather wastes; washing the leather wastes that have undergone the neutralizing; combining the fatliquoring agents to the leather wastes after the washing; adhering the fatliquoring agents to the leather wastes after the combining; and washing the leather wastes after the adhering;

separating leather fibers from the leather wastes of the pre-processing;

mixing the leather fibers with fibers for improving a tensile strength of the leather fibers to produce a mixed leather fibers; and forming sheets by combining the mixed leather fibers with raw fabrics for flooring, wherein the forming includes:

aligning the mixed leather fibers by using carding machines to produced aligned fibers;

stacking the raw fabrics for flooring and the aligned fibers by crossing each other; and forming sheets by combining the raw fabrics for flooring to the aligned fibers where needle punches hit in 800 to 1,000 times.

2. The method of claim 1, wherein the neutralizing is performed by mixing 90 to 100 parts by weight of water, 1 to 5 parts by weight of sodium formate, and 1 to 5 parts by weight of sodium bicarbonate based on the 100 parts by weight of the leather wastes.

3. The method of claim 1, wherein the combining is performed by mixing 90 to 100 parts by weight of water, 0.5 to 1.5 parts by weight of aqueous ammonia, and 15 to 19 parts by weight of fatliquoring agents based on the 100 parts by weight of the leather wastes.

4. The method of claim 1, wherein the adhering is performed by adding 0.5 to 2.0 parts by weight of formic acid based on the 100 parts by weight of the leather wastes.

5. The method of claim 1, wherein the separating includes:

cutting the leather wastes that have undergone the pre-processing to 5 to 15 cm by using leather grinding machines;

breaking bonds between leather fibers of the leather wastes by using hammer mills or roll mills; and separating leather fibers from the leather wastes where the bonds between leather fibers have been broken by using leather cotton gins.

6. The method of claim 1, wherein the mixing is performed by mixing 10 to 20 parts by weight of the fibers to improve a tensile strength based on the 100 parts by weight of the separated leather fibers.

7. The method of claim 6, wherein the fibers to improve a tensile strength include at least one of crimped yarn, wool, polypropylene, low melt fiber, and hot melt fiber.

8. The method of claim 1, wherein the method of preparing recycling leather sheets using leather fibers further comprises pressing the sheets by using roll mills.

9. The method of claim 1, wherein the method of preparing recycling leather sheets using leather fibers further comprises painting surfaces, and wherein the painting includes: applying binders to sheet surfaces by using roll coaters; drying the binders applied to the sheet surfaces by using dry chambers; forming embossings on the sheet surfaces where the binders are located; and applying top clear coating sprays and antifouling sprays to the sheet surfaces where embossings are formed.

10. The method of claim 1, wherein the recycling leather sheets comprises: fiber layers including the leather fibers and the fibers mixed with the leather fibers for improving a tensile strength of the leather fibers; and layers of the raw fabrics for flooring located on upper surfaces of the fiber layers with physically or chemically being combined with the fiber layers.

* * * * *